United States Patent [19]

Schumacher et al.

[11] 4,310,338

[45] Jan. 12, 1982

[54] REPLACEABLE FLOAT OIL SEPARATOR

[75] Inventors: Ernest W. Schumacher, De Soto, Tex.; Stephen E. Evans, Beltsville, Md.

[73] Assignee: Virginia Chemicals Inc., Portsmouth, Va.

[21] Appl. No.: 135,780

[22] Filed: Mar. 31, 1980

[51] Int. Cl.[3] ..... F25B 43/02

[52] U.S. Cl. ..... 62/470; 62/84

[58] Field of Search ..... 62/84, 468, 470, 471, 62/472, 473

[56] References Cited

U.S. PATENT DOCUMENTS

| | | | |
|---|---|---|---|
| 3,070,977 | 1/1963 | Kimmel et al. | 62/84 |
| 3,283,532 | 11/1966 | Kocher | 62/473 |
| 3,777,509 | 12/1973 | Muench | 62/470 |

*Primary Examiner*—Ronald C. Capossela
*Attorney, Agent, or Firm*—Depaoli & O'Brien

[57] ABSTRACT

A replaceable float oil separator, for installation in large refrigeration systems of the vapor compression type using refrigerant-immiscible lubrication oils, comprises a compact float assembly that is disposed transversely to the axis of its vessel and a removal assembly on the side of the vessel through which the float assembly can be removed for repair or replacement. The float assembly is compact in its design because a counterweight supports up to 90%, preferably 60%, of the weight of the float ball, in accordance with an energy balance equation. The removal assembly includes a flange cover, an o-ring, and a flange which is attached to the cylindrical side of the vessel, near its bottom where temperature cycling is minimal, whereby the vessel is semi-hermetically sealed. The float assembly is entirely supported by its oil return line which is attached to and passes through the flange cover of the removal assembly. Because the oil return line is off-centeredly disposed in the flange cover, the float assembly can be replaced only in its correct operating position when the flange cover is bolted onto the flange.

22 Claims, 11 Drawing Figures

Fig. 5
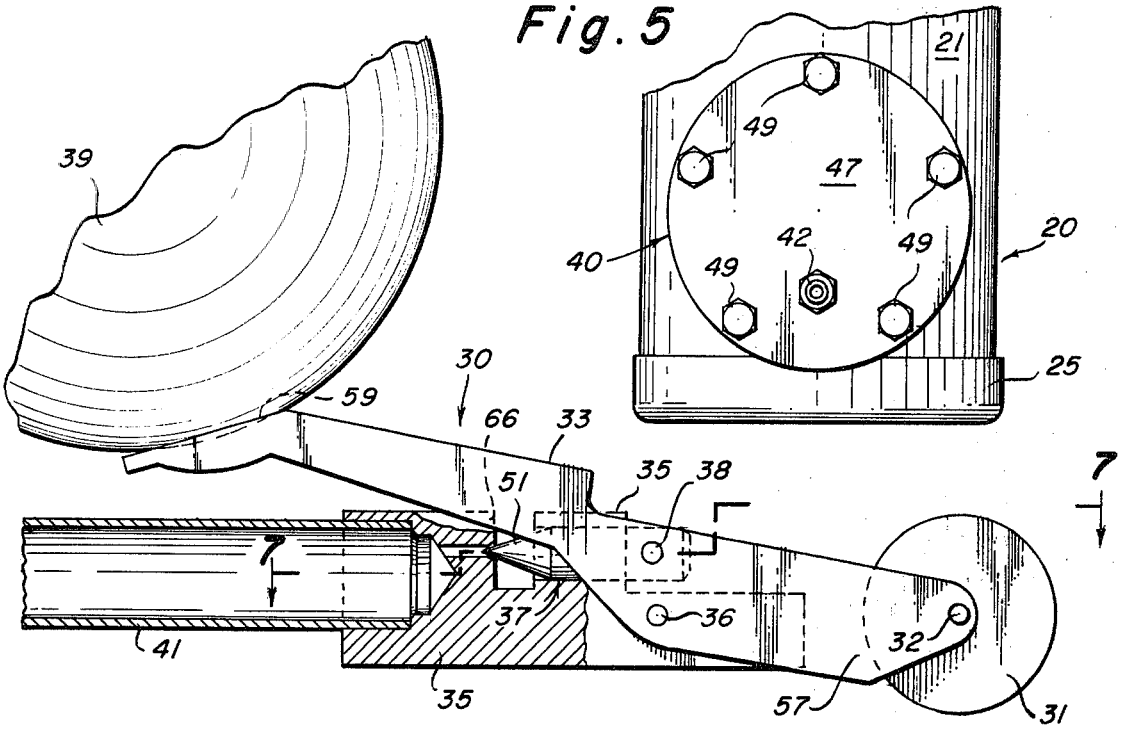
Fig. 6
Fig. 7
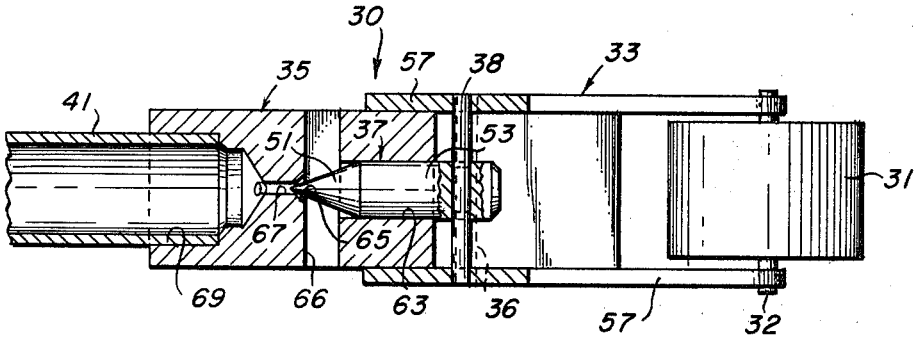

Fig. 8
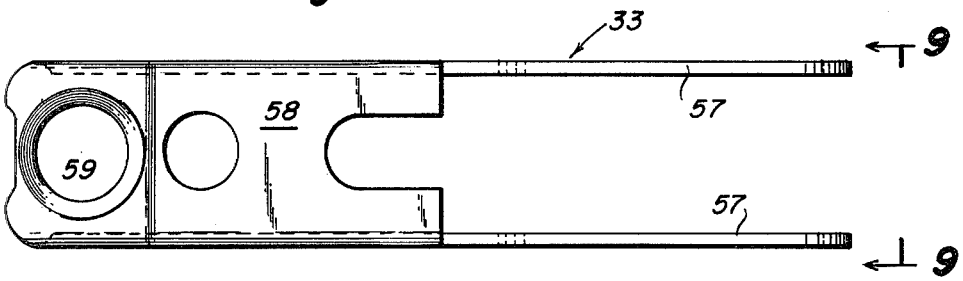
Fig. 9
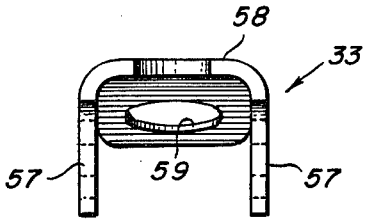
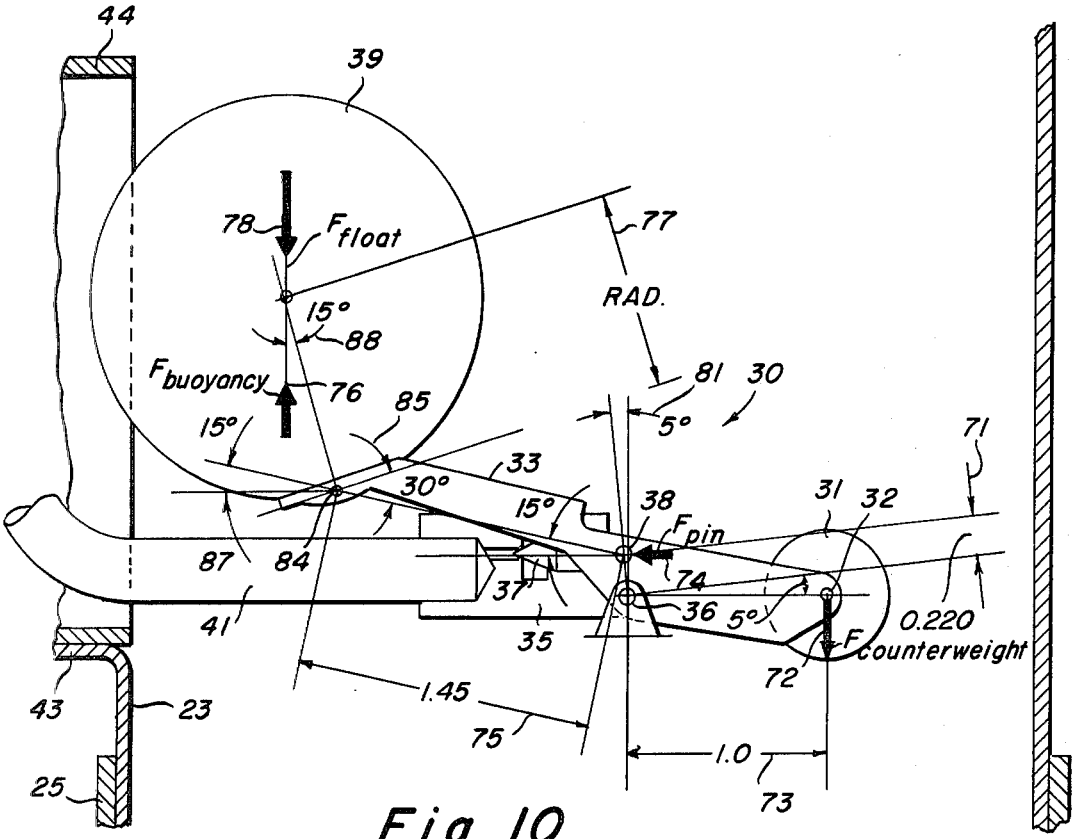
Fig. 10

REPLACEABLE FLOAT OIL SEPARATOR

BACKGROUND OF THE INVENTION

1. Field of the Invention

This invention relates to refrigeration systems of the vapor compression type and particularly to devices on the high pressure side of the compressor for intercepting and separating most of the lubricant flowing from the compressor to the condenser and returning the lubricant directly to the compressor oil sump. This invention especially relates to float-actuated oil separators of the repairable type.

2. Review of the Prior Art

There are many devices which operate on the discharge side of the evaporator and the suction or low-pressure side of the compressor, such as a suction accumulator. Such devices are useful for intercepting the liquid and vapor flowing to the compressor in highly variable proportions, for collecting a liquid refrigerant/oil mixture, and for entraining the mixture as droplets with the vapor that is flowing to the compressor. These devices essentially protect the compressor from being damaged by slugs of liquid.

Other devices operate on the high-pressure side of the compressor. Some are disposed between the compressor and the condenser for the purpose of returning oil to the compressor oil sump. Others are located in the line between the condenser and the evaporator and operate entirely on liquid formed in the condenser. They generally function as driers to remove moisture and as filters to remove very fine particles.

An oil return system for a refrigeration apparatus is described in U.S. Pat. No. 3,777,509, for example, in which an oil separator is disposed between a pair of compressors and the condenser. The oil separator returns the oil to the compressors through an oil still.

Such a system is desirable in any refrigeration system of the vapor compression type because the quantity of oil that is needed is thereby minimized, volume available for the working fluid is maximized, and the oil is concentrated where it is needed. Home freezers basically use Refrigerant 12 which is very miscible with oil at all temperatures and dilutes oil easily, so that the oil never coats the interior of the evaporator at the operating temperature of about −10° F. Consequently, home freezers do not need an oil separator.

In large refrigeration systems such as those employed by supermarkets for cooling produce and maintaining frozen items at adequately low temperatures, however, it is particularly undesirable to permit the crankcase oil to circulate throughout the entire system. This is so because such a system uses Refrigerant 502 in which oil is soluble at ambient and higher temperatures but is relatively insoluble at temperatures within the range of −35° to −40° F. In consequence, the oil readily coats the evaporator surfaces so that heat transfer is reduced and thermodynamic properties of the refrigerant itself and of the evaporator are changed.

It is also a pertinent characteristic of such supermarket refrigeration systems at the present time that they have to be defrosted at regular intervals. It is consequently sufficient improvement to existing commercial systems if the accumulation of oil being trapped in the evaporator between defrosting operations can be delayed so that heat transfer properties of the evaporator are not unduly impaired between defrostings.

In large refrigeration systems, such as those used in supermarkets, oil separators are commonly installed in the discharge line of the compressor for separating, containing, and returning refrigeration oil to the compressor crankcase. They may be either disposable or repairable. However, the repairable types are subject to leakage because of frequent cycling of temperatures. Such cycling is caused by rapid heating, when the hot compressed refrigerant passes through the oil separator, and subsequent cooling during the intervals when the compressor is shut down.

Such prior art oil separators comprise a pair of strainers which are disposed in series so that one catches oil on the inside and the other catches oil on the outside. The mesh of these strainers can be varied, but in the prior art it is common to use 40×40-mesh brass strainers having crimped bottoms which are fused together by spot welding. The strainers are separated by an "L" shaped baffle and allow separated oil to drip into the lower portion of the cylindrical vessel. In this lower portion, close to the bottom of the vessel, a float assembly is positioned. This float assembly comprises a float ball attached to a lever arm for slideably operating a needle valve within a valve body to open and close a valve seat and allow oil to be sent upwardly through a pickup tube and returned through the top of the vessel to the compressor oil sump.

The strainers are capable of operating with up to 100 times as much dirt as would clog a liquid-line filter-drier. However, they are mainly adapted for catching larger dirt particles than the filter-driers. A magnet is also commonly disposed at the bottom of the cylindrical vessel for catching and holding metallic contaminants.

The float ball must be pressure tight and generally contains a dye penetrant for use in detecting leaks by visual inspection. This dye is placed on the inside of the float ball when it is manufactured and stays there forever if there is no leak. The float ball is strong enough so that it withstands crushing forces up to at least 1,000 psi. The safe working pressure of the oil separator is generally about 450 to 500 psig.

R502 refrigerant sometimes contains as much as 2% oil which is soluble in the refrigerant at compressor discharge temperatures but which is insoluble at cold evaporator temperatures. An oil separator of the prior art will trap 95–98% of all the oil which would normally be circulating throughout the system.

Leakage occurs in repairable oil separators, having a flange top for maintenance of the float assembly, because the top is alternately heated, when the hot compressed gasses flow through the strainers, and cooled, when the compressor is idle. Thus, the gasket expands and contracts and eventually acquires a set so that leakage occurs.

There is consequently a need to make a sealed joint which is not subject to expansion and contraction. It is also desirable to be able to hermetically seal the top of the vessel and at the same time be able to remove the float assembly for inspection, maintenance, and/or replacement.

SUMMARY OF THE INVENTION

It is accordingly an object of this invention to provide a repairable oil separator, for use in large refrigeration systems, that is float actuated but semi-hermetically sealed.

It is also an object to provide a replaceable float assembly that is removeable through the side of the oil separator.

It is further an object to provide a float assembly which includes a float ball that is approximately one-half the diameter of float balls utilized in prior art separators of equal size.

It is still further an object to provide a removal assembly, for selectively replacing the float assembly, that is disposed at the side of the cylindrical vessel of the oil separator and is as close to its bottom as possible.

It is another object to provide a removal assembly that is semi-hermetically attached to the side of the vessel with an o-ring.

It is an additional object to attach the float assembly only to the removal assembly, so that the removal assembly supports the float assembly and obviates support by a retaining rod attached to the shell of the vessel.

It is still another object to provide a means for counterbalancing the float ball to a selected extent.

It is additionally an object to provide a method for selectively counterbalancing the float ball according to an energy balance equation.

In accordance with these objectives and the principles of this invention, a oil separator is herein provided that comprises a cylindrical vessel, a removal assembly which is semi-hermetically attached to the side of the vessel and near its bottom, and a replaceable valve assembly which is lighter and more compact than prior art units.

In particular, because of its compactness, the valve assembly does not have to be removed and replaced by removing the top cover of the cylindrical vessel. Instead, it is removed through a flanged opening in the side of the vessel and near its bottom where temperatures are inherently more nearly uniform than at the top of the vessel, whereby expansion and contraction are relatively slight and the removal assembly is subject to much less drastic cyclic deformation. Moreover, the removal assembly comprises a precision o-ring seal with five bolts that provide an indexed clamping arrangement, so that the valve assembly is always inserted in the same position.

The removal assembly also includes an oil return tube which is attached at one end to the flange, is attached at the other end to the valve assembly, and is preferably bent into an "S" shape therebetween in order to mount the valve assembly close to the bottom of the vessel in order to minimize the quantity of oil that would be operably stored within the vessel.

Being able to use an o-ring seal instead of the fiber-filled gasket of the prior art is an important feature of this invention because an o-ring enables a flange to be more precisely sealed across a wide opening and because an o-ring inherently resists deformation from changes in temperature and pressure. Therefore, in combination with the milder conditions occurring near the bottom of a vessel in an oil separator, as compared to its top, an o-ring provides a vastly more stable and leakproof seal than has heretofore been available in the prior art.

The valve assembly, like prior art valve assemblies, includes a valve body having a valve seat, a bore which is flow-connected to the valve seat and sealably attached to the intake end of the oil return tube, a valve needle that moves slideably within the valve body and sealably seats against the valve seat for closing the bore and oil return tube, a lever arm which is pivotably attached to the valve body with a body pin and to the valve needle with a needle pin, and a float ball which is attached to one end of the lever arm. Unlike prior art valve assemblies, it additionally includes a counterweight which is attached to the other end of the lever arm.

Because the oil return tube and the valve assembly are horizontally disposed, athwart the longitudinal axis of the vessel, however, lowering of the oil level causes the float ball to revolve toward the oil return tube, contrary to the prior art arrangement wherein lowering of the oil level causes the float ball to revolve away from the oil return tube. This change is created by reversing the locations of the needle pin and body pin.

The valve assembly achieves its compactness by using a counter-balanced arrangement for its lever arm, by disposing its oil return line and valve needle transversely to the longitudinal axis of the vessel, and by counterbalancing the components of its valve assembly according to a precisely calculated energy balance equation. This equation preferably decreases the buoyancy force required to balance the valve assembly by 60% of the counterweight load. The oil return line is preferably also curved, so that the valve assembly operates at a level within the vessel that is lower than the flange opening, whereby the quantity of oil that must be stored within the vessel at all times is reduced.

The radius of the float ball is 2.0 inches in the prior art design whereas in the design of this invention, the radius is preferably 1.0 inch, utilizing a counterweight. This reduction in size of the float ball is an important feature of the invention, because it enables the design of the entire replaceable valve assembly to be sufficiently compact that it is feasible to dispose the assembly athwart the longitudinal axis of the cylindrical shell, and it is particularly feasible to insert and remove the assembly through a side opening without having to increase the diameter of the shell.

The 60% of the counterweight load that counterbalances the weight of the float ball is chosen as most suitable for two purposes: (1) achieving adequate closure of the valve and (2) minimizing the quantity of oil that must be stored in the vessel. The closer to perfect balancing that is provided, the more danger there is of non-closure of the valve. Thus, the maximum counterbalancing that can be safely provided is 90% of the buoyancy force; the minimum is 0%. The less counterbalancing that is provided, the more firmly the valve needle is seated when the oil level is low, and the higher the level of oil that must be accumulated for floating the ball enough to open the valve. The more counterbalancing that is provided, the less firmly the valve needle is seated when the oil level is low, and the lower the level of oil that must be accumulated for floating the ball enough to open the valve.

Essentially the same pressure differential exists across the valve as across the compressor. Normal operating pressure differentials are 100–300 psi. More counterbalancing force may be used to offset additional valve unbalance caused by higher pressure differentials.

The angle of the head of the valve needle is not critical, but tight seating is important. If the angle is too small, such as 30° or less, the valve needle may stick in the orifice.

If the valve needle is not firmly enough seated, leakage may occur through the oil return line to the compressor. If the leak rate through the valve is equal to or greater than the trapping rate for the oil, the valve leakage eventually allows hot refrigerant vapor to return to the compressor, causing loss of capacity and possible compressor damage. On the other hand, if the leak rate is less than the oil trapping rate, there will be no problem.

The oil return line is normally at ambient temperature. If such leakage occurs, the oil return line becomes hot to the touch, so that leakage is readily detected.

The counterbalanced float assembly of the invention is suitably constructed of a low-carbon mild steel, brass, or stainless steel. However, a variety of materials, depending upon corrosion characteristics, can be used. For other liquid materials, e.g., $CCl_4$, a solid plastic ball would theoretically be possible.

It is true that the specific gravity of machine steel, for example, is 7.80, and the specific gravity of mineral oil lubricants is 0.88–0.94, but the entire float assembly is immersed in the oil except the portion of the float ball that is above the liquid surface. Moreover, the float ball is hollow. Thus a correction in the energy balance equation for the portion of the float ball that is above the oil surface is relatively slight and can be neglected for general design purposes.

Suitable pressures across the valve needle are 50 psi to 300 psi. If no counterweight is used, the quantity of oil that is required to open the valve rises very steeply at about 80 psi. The more counterbalancing that is provided, the smaller the quantity of oil that is required to open the valve at a constant pressure differential across the valve needle. Furthermore, the more counterbalancing that is provided, the lower becomes the ratio of oil quantity to pressure differential. Therefore, the higher the operating pressures, and the consequently higher pressure differentials that exist across the valve needle, the more counterbalancing force must be provided, such as 80% counterweight instead of 60%.

BRIEF DESCRIPTION OF THE DRAWINGS

FIG. 5 is a elevation of the inspection flange on the side of the oil separator of FIG. 3, looking in the direction of the arrows 5—5 in FIG. 3.

FIG. 6 is a side view, partly in section, of the valve assembly seen in the oil separator of FIG. 3.

FIG. 7 is a sectional top view, taken in the direction of the arrows 7—7 in FIG. 6.

FIG. 8 is a top view of the lever arm in the valve assembly in FIGS. 6 and 7.

FIG. 9 is a right side view of the lever arm of FIG. 8, taken in the direction of the arrows 9—9 in FIG. 8.

FIG. 10 is a side view, similar to FIG. 6, with angles and dimensions of a highly preferred embodiment placed thereon for calculating float force, buoyancy force, counterweight force, and pin force.

DESCRIPTION OF THE PREFERRED EMBODIMENTS

Figure 2:
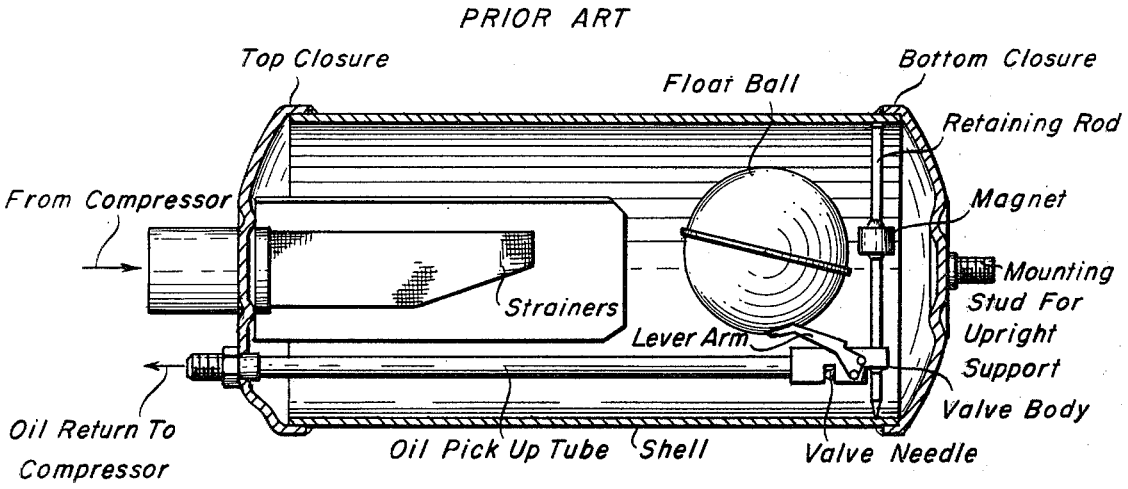
FIG. 2 is a sectional elevation of an oil separator of the prior art which is always mounted in upright position, supported on its mounting stud.

Oil separators of the prior art, for separating oil from the hot, highly compressed vapor passing from the compressor to the condenser of a refrigeration system containing R502 refrigerant, or other refrigerant, may be of the disposable type, as shown in FIG. 2, or may be of the replacement or repairable type having a flanged top closure which is securely bolted to the shell and hermetically sealed with a gasket. Either type comprises a pair of screens and a baffle which separate oil from refrigerant after leaving the inlet port and before entering the exit port.

The float assembly of the prior art is within the cylindrical shell and above the welded bottom closure as seen in FIG. 2. It comprises a retaining rod which is horizontally disposed and connected to a valve body which is attached to a vertically disposed oil pickup tube and tube extension leading to the suction side of the compressor. The valve body surrounds a vertically disposed needle that closes the pickup tube and is slideably moved by a hinge pin at one end of a lever arm which is attached at its other end to a float ball. A magnet on the retaining rod holds metal particles which fall into the oil at the bottom of the vessel. The weight of the hollow float ball is multiplied as it is lowered by the decreasing level of oil, after the valve needle has opened the pickup tube, until it finally closes the pickup tube when the oil has been lowered to a pre-selected level.

The oil separator of this invention is shown in FIGS. 3–10 as a replacement type. It generally comprises a cylindrical vessel which is identical to those used in the prior art except that the flange for removing and replacing its valve assembly is located on the side of the vessel, close to its bottom, where temperature cycling is minimal.

Oil separator 20 of this invention specifically comprises a cylindrical shell 23, a top closure 21, a bottom closure 25, a valve assembly 30, and a removal assembly 40. Closures 21, 25 are both welded to shell 23 to form a cylindrical vessel which is operably disposed in upright position. Oil separator 20 further comprises a pair of entrance and exit screens 26 and a baffle 24 therebetween. Inlet screen 26 is connected to inlet port 28, and exit screen 26 is connected to exit port 29.

Removal assembly 40, as seen in FIGS. 3, 4, 5, and 10, comprises out-turned edge 43 of shell 23, flange adapter 44 which is welded or brazed within out-turned edge 43, flange ring 45 surrounding adapter 44, flange cover 47 which closes off the opening formed by adapter 44, an o-ring seal 46 which is held in a groove on the inner side of flange cover 47, a plurality of bolts 49 which hold together flange 45 and flange cover 47 while compressing o-ring seal 46, an oil return tube 41 having a discharge end inserted through an opening in flange cover 47, and a flare connector 42 which is sealably and rigidly attached to flange cover 47 and to the discharge end of oil return tube 41. Adapter 44 and flange 45 are preferably formed from a single piece of material, such as metal. Oil return tube 41 is preferably bent into an "S" shape in order that valve assembly 30 can be as close as possible to bottom closure 25, whereby the quantity of oil being stored within the vessel is minimized.

Valve assembly 30, as seen in FIGS. 6–10, comprises a valve body 35 which is sealably and rigidly attached to the feed end of oil return tube 41, a valve needle 37 which is slideably positioned within valve body 35, a lever arm 33 which is hingeably attached to valve body 35 and to valve needle 37, a counterweight 31 which is hung by a counterweight pin 32 on the lower end of lever arm 33, and a float ball 39 which is rigidly attached to the upper end of lever arm 33. The hinge pins connecting lever arm 33 to valve body 35 and to valve needle 37 are, respectively, body pin 36 which acts as a fulcrum for lever arm 33 and needle pin 38 which transmits a sliding force to valve needle 37.

Lever arm 33 comprises a top 58, a pair of sides 57, and a downwardly bent ball support surface 59, having a circular opening, which is peripherally parallel to the surface of float ball 39, as best seen in FIGS. 6 and 10. Support point 84 for float ball 39 is centered within the circular opening and is on the periphery of float ball 39, as seen in FIG. 10.

Valve needle 37 comprises a pointed end 51 and a cylindrical body 53. Valve body 35 comprises a hole for body pin 36, a slide bore 63 for valve needle 37, a valve needle seat 65, a transversely disposed feed slot 66, a bore 67 which is closed by valve needle 37, and an exit bore 69 into which the intake end of oil return tube 41 is securely and sealably attached. Pointed end 51 of needle 37 fits precisely against seat 65, but body 53 slides loosely within bore 63.

The distance 71 separating pins 36, 38 is 0.220 inch in the preferred embodiment shown in FIG. 10. The distance 73 between counterweight pin 32 and body pin 36 is 1.0 inch for this embodiment in which 60% of the weight of counterweight 31 counterbalances float ball 39. The distance 75 between needle pin 38 and support point 84 is 1.45 inch. The distance between that support point 84 and the center of float ball 39 is radius (RAD) 77. This radius is 1.0 inch.

Ball support angle 85 between the tangent at support point 84 and the line connecting needle pin 38 with ball support point 84 is 30°. Angle 87 between the horizontal and the line connecting pin 38 with support point 84 is 15°. Ball tilt angle 88 between the vertical and the radius through point 84 is 15°. Angle 81 between the vertical and the line connecting pins 36, 38 is 5°. All these dimensions and angles are inserted into the equations of Examples 1 and 2.

The dimensions and the forces shown in FIG. 10 may be more easily understood by referring to the following examples:

EXAMPLE 1

Energy Balance on Float Valve Without Counterweight

The following equations, referring to FIG. 10, are applicable for the dimensions and angles therein on a float valve having no counterweight:

$$F_{buoyancy}\times(0.22\sin 5^\circ+1.45\cos 15^\circ+\mathbf{RAD}\sin 15^\circ)=F_{float}\times(0.22\sin 5^\circ+1.45\cos 15^\circ+\mathbf{RAD}\sin 15^\circ)+F_{pin}\times(0.22\cos 5^\circ)$$

With RAD (radius of float ball 39) equalling 2.0 inches:

$$1.94\times F_{buoyancy}=1.94\times F_{float}+0.219\times F_{pin}$$

$$F_{buoyancy}=F_{float}+0.11F_{pin}$$

EXAMPLE 2

Energy Balance on Float Valve with Counterweight

When using a float valve with a counterweight, the following equations are aplicable for the dimensions and angles seen in FIG. 10 to give the energy balance thereon:

$$F_{buoyancy}\times(0.22\sin 5^\circ+1.45\cos 15^\circ+\mathbf{RAD}\sin 15^\circ)+F_{counterweight}\times(1.0)=F_{float}\times(0.22\sin 5^\circ+1.45\cos 15^\circ+\mathbf{RAD}\sin 15^\circ)+F_{pin}\times(0.22\cos 5^\circ)$$

With RAD (radius of float ball 39) equalling 1.0 inch:

$$1.68\times F_{buoyancy}+F_{counterweight}=1.68\times F_{float}+0.219\times F_{pin}$$

$$F_{buoyancy}=F_{float}+0.13F_{pin}-0.60F_{counterweight}$$

These equations show that the buoyancy force that is required to balance the valve assembly is decreased by 60% of the counterweight load. It should be noted that FIG. 10 contains four forces, three acting essentially vertically and one acting essentially horizontally. The buoyancy force 76 ($F_{buoyancy}$) is opposed by the float force 78 ($F_{float}$), both of which act upon the center of float ball 39. Counterweight force 72 ($F_{counterweight}$) acts upon pin 32 and represents the weight of counterweight 21. Pin force 74 ($F_{pin}$) acts essentially horizontally upon needle pin 38. Of course, a vertically aligned and upwardly directed support force could also be shown as acting upon body pin 36, equalling the combined weight of counterweight 31, counterweight pin 32, lever arm 33, body pin 36, needle pin 38, valve needle 37, valve body 35, and float ball 39.

Figure 11:
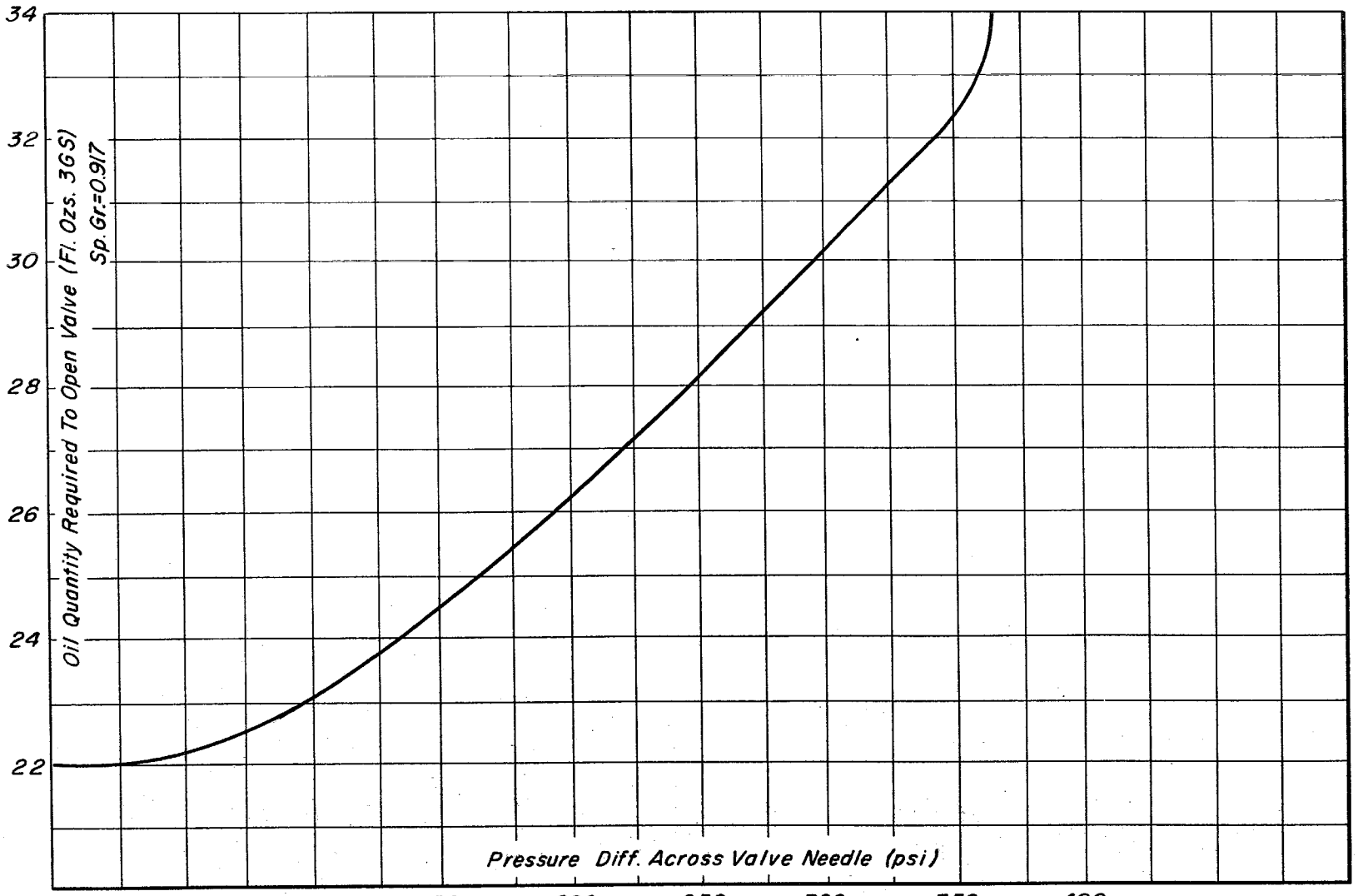
FIG. 11 is a graph showing the relationship of oil quantity required to open the valve as a function of the pressure differential across the valve needle.

FIG. 11 contains a curve representing the quantity of oil (fluid ounces of oil, having a specific gravity of 0.917) that is required to open a valve in an oil separator of this invention, in which 60% of the counterweight load is utilized to balance the float ball, as a function of the pressure differential across the valve needle. Without the counterweight, the quantity of oil that would be required to open the valve would rise very steeply at about 80 psi. Thus, the instant invention enables oil to continue to be separated and returned to the compressor oil sump at a penalty of only about 0.04 ounces of oil per psi of increased operating pressure across the valve needle, in contrast to prior art devices which are susceptible to being rendered inoperable, because of drastically increased oil requirements, by even mid-range pressure increases.

The attachment of the float and removal assemblies 40, 30 of this invention, whereby flange cover 47 supports the weight of float assembly 30, eliminates the horizontally disposed retaining rod of the prior art, as seen in FIG. 2, and permits float assembly 30 to be removed as a unit from shell 23 when flange cover 47 is detached from flange 45. Replacement of float assembly 30, or a part thereof, is thereby simplified. Because of the indexing arrangement of bolts 49, as seen in FIG. 5, it is possible to replace float assembly 30 in one position only, and this position is the precisely correct position for satisfactorily operating oil separator 20.

Figure 1:
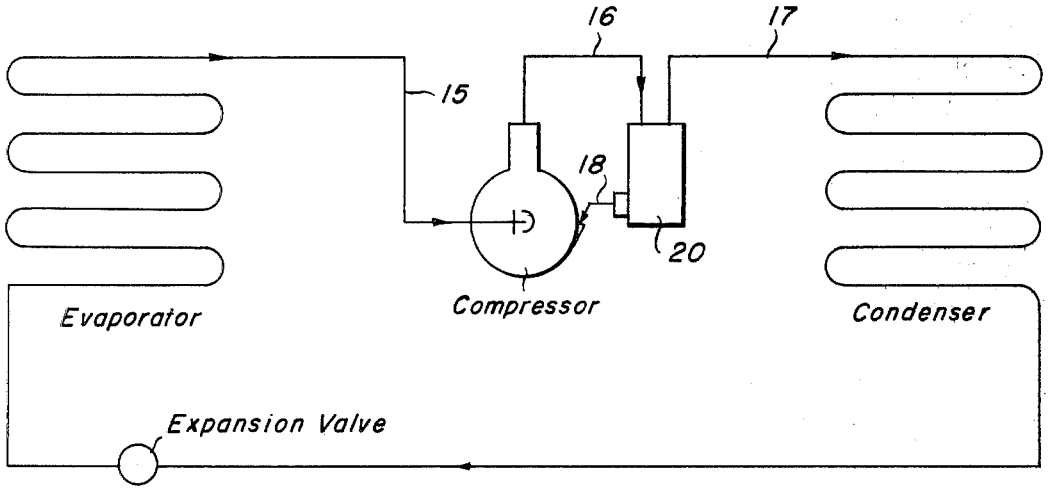
FIG. 1 is a schematic flow sheet showing a refrigeration process of the prior art, comprising an oil separator for separating oil from the hot refrigerant-oil mixture and returning the separated oil to the compressor oil sump.
Figure 3:
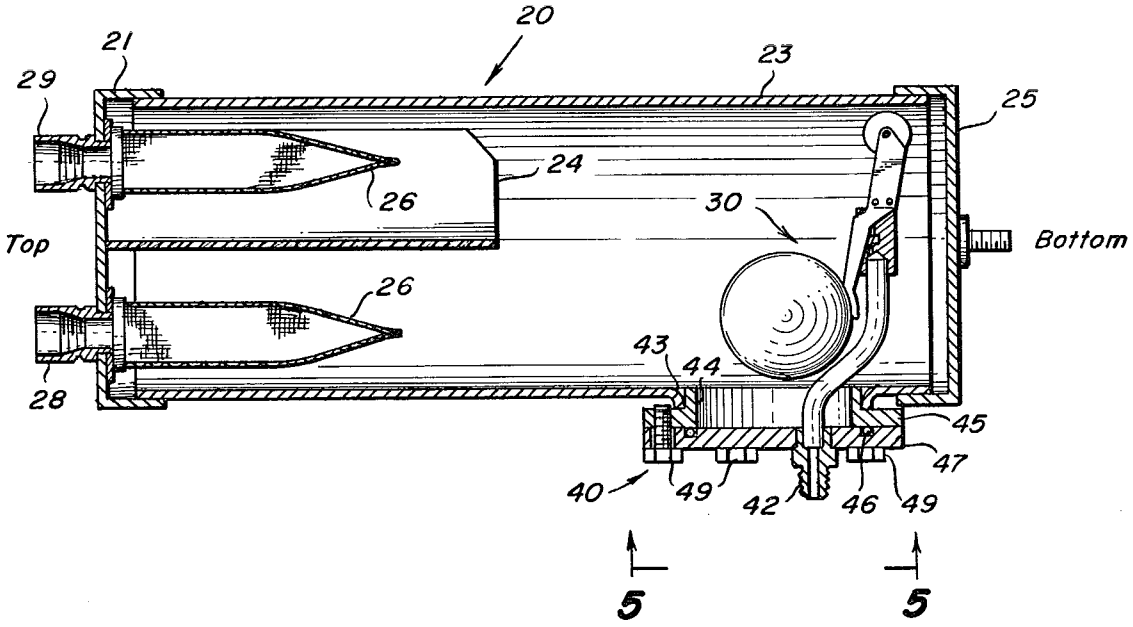
FIG. 3 is a sectional elevation, similar to FIG. 2, and looking in the direction of the arrows 3—3 in FIG. 4, of the oil separator of this invention.
Figure 4:
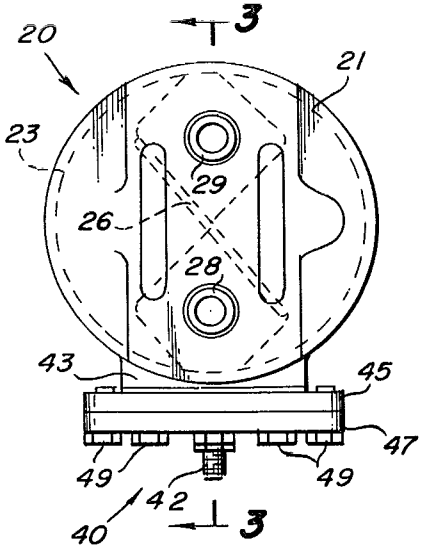
FIG. 4 is a top view of the oil separator seen in FIG. 3.

When oil separator 20 of this invention is installed in the discharge line of a refrigeration system as shown in FIG. 1, it intercepts the oil and refrigerant in line 16, separates the oil from the refrigerant, sends the refrigerant through line 17 to the condenser, and returns the refrigeration oil through line 18 to the compressor oil sump. Such short-circuiting of the return route for the refrigeration oil is more desirable than permitting the refrigeration oil to circulate throughout the entire system. By use of the oil separator of this invention, the refrigeration oil spends the major portion of its time in the crankcase of the compressor, where it is needed.

Because it will be readily apparent to those skilled in the art that innumerable variations, modifications, applications, and extensions of the examples and principles hereinbefore set forth can be made without departing from the principles and scope of the invention, what is herein defined as such scope and is desired to be protected should be measured, and the invention should be limited, only by the following claims.

What is claimed is:

1. In an oil separator of the repairable type, having a cylindrical shell and top and bottom closures for forming a pressure vessel for installation in a large refrigeration system of the vapor compression type between the compressor and the condenser, wherein a refrigeration oil and a refrigerant are combined and circulated throughout the refrigeration system, said oil being soluble at ambient and higher temperatures in said refrigerant but being insoluble at refrigeration temperatures, the improvement in said oil separator that provides hermetic attachment of said top and bottom closures to said shell and comprises:

A. a removal assembly, comprising:

(1) a flange cover which is semi-hermetically attached to a flanged opening in said cylindrical shell, said flanged opening being near the bottom of said shell, and (2) an oil return tube which is disposed approximately perpendicularly to the longitudinal axis of said shell, for returning a storage quantity of said oil to the sump of said compressor, and which has a discharge end and an intake end, said discharge end being rigidly and sealably attached to said flange cover; and B. a valve assembly which is substantially immersed in said storage quantity and is removable and insertable through said flanged opening, comprising:

(1) a valve body having a valve seat and, in flow connection, a bore which is sealably attached to said intake end, (2) a valve needle which moves slideably within said valve body and sealably seats against said valve seat for closing said oil return tube, (3) a lever arm, having an upper end and a lower end, which is pivotably attached to said valve body with a body pin and to said valve needle with a needle pin, (4) a float ball which is attached to and supported by said upper end, and (5) a counterweight which is attached to and supported by said lower end for enabling said oil to be separated and returned to said compressor at a storage penalty of about 0.04 ounces of said oil in said storage quantity per psi of increased operating pressure across said valve needle when said oil has a specific gravity of 0.88–0.94.

2. The improvement in the oil separator of claim 1, wherein said oil return tube is bent into a "S" shape, whereby said valve body is close to the bottom of said oil separator and said storage quantity is reduced.

3. The improvement in the oil separator of claim 2, wherein 60% of the weight of said counterweight counterbalances the weight of said ball.

4. The improvement in the oil separator of claim 3, wherein the distance from the point supporting said ball on said lever arm to said needle pin is approximately 1.5 times the distance from said needle pin to the center of said counterweight.

5. The improvement in the oil separator of claim 4, wherein the angle between the line connecting said needle pin to said point supporting said ball is approximately 15°.

6. The improvement in the oil separator of claim 5, wherein the distance between said needle pin and said body pin is approximately 0.22 inch.

7. The improvement in the oil separator of claim 6, wherein the distance between said center of said counterweight to said body pin is approximately 1.0 inch.

8. The improvement in the oil separator of claim 7, wherein the angle between the horizontal and the line connecting said needle pin with said point supporting said ball is 15°.

9. The improvement in the oil separator of claim 8, wherein the angle between the vertical and the line connecting said needle pin with said body pin is 5°.

10. The improvement in the oil separator of claim 9, wherein the energy balance on said float assembly is calculated by an energy balance equation which includes a float force ($F_{float}$) and a buoyancy force ($F_{buoyancy}$) which are exerted vertically at the center of said float ball, a counterweight force ($F_{counterweight}$) which is exerted vertically at the center of said counterweight, and a pin force ($F_{pin}$) which is exerted horizontally on said needle pin, said equation being:

$$F_{buoyancy}=F_{float}+0.13F_{pin}-0.60\ F_{counterweight}.$$

11. The improvement in the oil separator of claim 10, wherein said float ball is one half its diameter without use of said counterweight.

12. The improvement of claim 1, wherein said float assembly is entirely supported by and removable with said flange cover.

13. In a large refrigeration system of the vapor compression type, comprising a compressor, a condenser on the high-pressure side of said compressor, an expansion valve and an evaporator on the low-pressure side of said compressor, and an oil separator of the repairable type which is disposed between said compressor and said condenser for separating refrigeration oil and refrigerant and for returning the separated oil from a storage quantity of said oil within said separator to the oil sump of said compressor, wherein said oil separator comprises an upright cylindrical shell having sealed ends to form a vessel, an inlet port at the top end thereof, and a longitudinal axis, the improvement in said oil separator which comprises:

A. a removal assembly which is:

(1) semi-hermetically attached to said cylindrical shell at a side opening which is near the bottom of said shell, and (2) rigidly attached to the discharge end of an oil return tube, having inlet and discharge ends, which is disposed transversely to said axis for performing said returning; and B. a replaceable valve assembly which is:

(1) sufficiently compact to be disposed athwart said axis, (2) operably disposed within said shell and substantially immersed within said quantity, and (3) insertable and removable as a unit through said side opening, said valve assembly comprising a valve needle controlling admission of said oil to said inlet end of said return tube and a counterbalanced float assembly which enables said oil to be separated and returned to said compressor oil sump at a storage penalty that is a substantially linear relationship to increased operating pressure across said valve needle over an operating pressure range of 50–300 psi.

14. The improvement in the oil separator of claim 13, wherein said relationship is measured as 0.04 ounces of said oil in said storage quantity per psi of said increased operating pressure when said oil has a specific gravity of 0.88–0.94.

15. The improvement of claim 14, wherein said replaceable valve assembly comprises a float ball on one end of a lever arm and a counterweight on the other end of said lever arm, said lever arm being pivotably attached to said valve needle with a needle pin.

16. The improvement in the oil separator of claim 15, wherein a portion of the weight of said counterweight is used for counterbalancing the weight of said float ball, thereby enabling said float ball to be reduced in size.

17. The improvement in the oil separator of claim 16, wherein the energy balance on said float assembly is calculated by an energy balance equation which includes a float force ($F_{float}$) and a buoyancy force ($F_{buoyancy}$) which are exerted vertically at the center of said float ball, a counterweight force ($F_{counterweight}$) which is exerted vertically at the center of said counterweight, and a pin force ($F_{pin}$) which is exerted horizontally on said needle pin.

18. The improvement in the oil separator of claim 17, wherein said portion is 60%, said equation being:

$$F_{buoyancy}=F_{float}+0.113\ F_{pin}-0.60F_{counterweight}.$$

19. The improvement in the oil separator of claim 18, wherein the diameter of said float ball is reduced to 50% of its diameter without said counterweight.

20. The improvement in the oil separator of claim 19, wherein the more said counterbalancing that is provided according to said energy equation, the smaller said quantity that is required to unseat said valve needle and permit said returning at a constant pressure differential across said valve needle.

21. The improvement in the oil separator of claim 19, wherein the more said counterbalancing that is provided according to said energy equation, the lower becomes said storage penalty.

22. The improvement in the oil separator of claim 19, wherein the higher the operating pressures and the higher the pressure differentials that exist across said valve needle, the more said counterbalancing that must be provided.

* * * * *

UNITED STATES PATENT OFFICE

CERTIFICATE OF CORRECTION

Patent No. 4,310,338 Dated January 12, 1982

Inventor(s) Ernest W. Schumacher and Stephen E. Evans

It is certified that error appears in the above-identified patent and that said Letters Patent are hereby corrected as shown below:

Column 8, line 7, "applicable" should be inserted in lieu of --aplicable--.

Claim 20 should depend upon "claim 17", not claim 19.

Claim 21 should depend upon "claim 17", not claim 19.

Claim 22 should depend upon "claim 17", not claim 19.

Signed and Sealed this

*Third* Day of *August 1982*

[SEAL]

*Attest:*

GERALD J. MOSSINGHOFF

*Attesting Officer* *Commissioner of Patents and Trademarks*